United States Patent [19]

Jacquier

[11] Patent Number: 4,883,946

[45] Date of Patent: Nov. 28, 1989

[54] HEATING APPARATUS, PARTICULARLY FOR THE HEAT TREATMENT OF A TUBE OF SMALL DIAMETER AND OF CURVED SHAPE

[75] Inventor: Paul Jacquier, Tassin la Demi-Lune, France

[73] Assignee: Framatome, Courbevoie, France

[21] Appl. No.: 172,819

[22] Filed: Mar. 25, 1988

[30] Foreign Application Priority Data

Mar. 25, 1987 [FR] France ..... 87 04158

[51] Int. Cl.[4] ..... H05B 3/06

[52] U.S. Cl. ..... 219/523

[58] Field of Search ..... 219/523, 522, 524, 525; 338/229

[56] References Cited

U.S. PATENT DOCUMENTS 1,326,964 1/1920 Poole ..... 219/523 X
3,407,283 10/1968 Peterson ..... 219/523 X
3,417,230 12/1968 Millikan ..... 219/523 X

FOREIGN PATENT DOCUMENTS 1104086 4/1961 Fed. Rep. of Germany .
2483157 11/1981 France .

*Primary Examiner*—E. A. Goldberg
*Assistant Examiner*—M. Lateef
*Attorney, Agent, or Firm*—Pollock, Vande Sande & Priddy

[57] ABSTRACT

The heating element (14) is in the form of a helical winding (31) made of a resistance heating wire which constitutes the central core of a coaxial cable (32) having a tubular metallic outer sheath and an insulating material interposed between the central core and the outer sheath. The coaxial cable (32) constitutes a helical winding (31). The apparatus can be used in particular for the heat treatment of the small bends of a bundle of tubes in a steam generator in a pressurized water nuclear reactor.

14 Claims, 7 Drawing Sheets

14
14'
14

1
2
3
3a
4
4a
4b
5
6a
6b
8
9
10
11
12
14(14')
15
16
17
18
19
20
21
22
24
25
26
27
28
60

FIG.2a
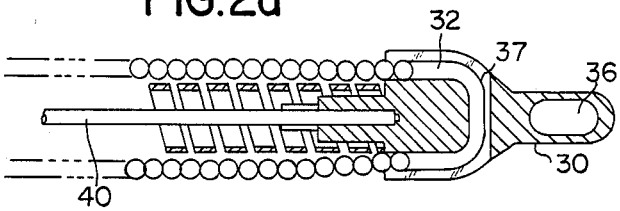
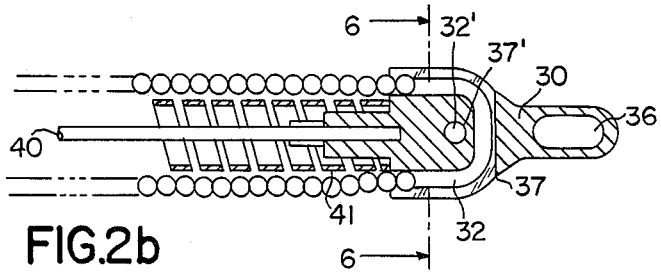
FIG.2b
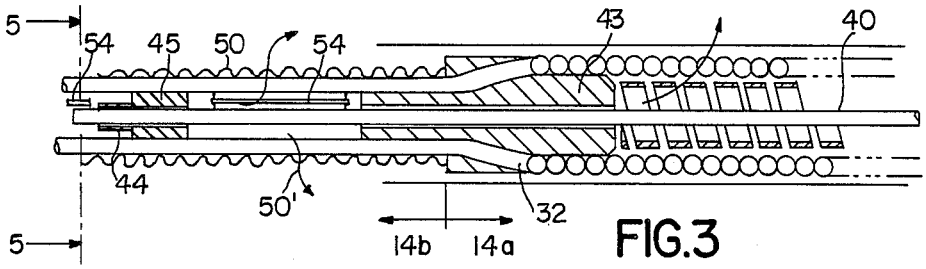
FIG.3
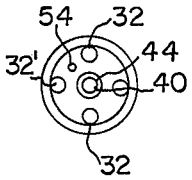
FIG.5
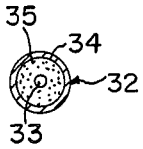
FIG.4
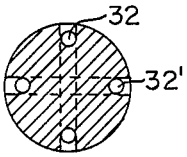
FIG.6

HEATING APPARATUS, PARTICULARLY FOR THE HEAT TREATMENT OF A TUBE OF SMALL DIAMETER AND OF CURVED SHAPE

FIELD OF THE INVENTION

The invention relates to a heating apparatus for the heat treatment of a tube of small diameter and of curved shape over at least part of its length, and to the utilization of this heating apparatus for, in particular, the heat treatment of steam generator tubes.

BACKGROUND OF THE INVENTION

The steam generators of pressurized water nuclear reactors comprise a bank of several thousand U-shaped tubes of a diameter close to two centimeters. Each tube comprises two rectilinear branches having a length close to ten meters and having their ends fixed in the tube plate of the steam generator, together with a substantially semicircular curved portion joining the two rectilinear branches at their tops.

The curved portions or bends of the tubes in a bank are not identical with one another, as the dimensions and radius of curvature of the bends depend on the position of the tubes in the tube bank. The bends of tubes lying in the central part of the bank have a much smaller radius of curvature than the bends of tubes situated towards the outside of the bank.

During the operation of a reactor, the tubes in the tube bank of a steam generator of a pressurized water nuclear reactor are in contact on their inner surface with the pressurized water circulating in the primary circuit and the vessel of the reactor, and on their outer surface with the feed-water which is introduced into the steam generator casing in order to be heated and vaporized by the heat supplied by the primary water.

The tubes of a steam generator in a pressurized water nuclear reactor are subject to corrosion during operation, and after a lengthy period of operation this may result in the cracking of these tubes in certain sensitive zones, such as the transition zone between the part of the tube which is deformed inside the tube plate during its fastening by crimping, and the undeformed part of the tube, or else the zone of the bends and their connection to the rectilinear branches. This severe corrosion and cracking in certain zones of the tube are connected with the presence in the tube wall of internal stresses resulting from the mechanical operations entailed in the shaping and installation of the tube bank, and of the external loads of thermal or mechanical origin undergone by the tube bank during the operation of the reactor.

Various methods have been proposed for the mechanical relief of stresses in tubes and have been used mainly for stress relieving in zones of the tubes situated inside or near the tube plate.

It has also been proposed to effect thermal stress relieving of the bands by introducing an electric resistance heating element into each of the tubes requiring treatment, starting from the water tank of the steam generator and disposing the heating element in the zone of the bend, the latter being heated for a determined period of time by supplying electric current to the heating resistor.

It is quite obvious that the operation of placing the heating element in position in the zone of the bend becomes increasingly difficult to achieve as the radius of curvature of the bend decreases. The heat treatment of the small bends of the bank is therefore a delicate operation which calls for the use of heating elements of special construction which can be placed in position in a part of the tube where the radius of curvature is small.

Heating elements of this kind may comprise a flexible mandrel on which an electric resistance wire is wound helically to form a winding whose outside diameter is smaller than the inside diameter of the tube to be treated.

The production of a flexible mandrel which can assume the curvature of the small bends and ensure satisfactory displacement and positioning of the heating element is extremely delicate and expensive. In addition, it is necessary to provide effective electrical and/or thermal insulation between the winding and the mandrel.

Furthermore, the tubes of the steam generator are often slightly ovalized in the zone of the bends, so that it is necessary to provide heating elements whose diameter is decidedly smaller than the inside diameter of the tube, and consequently the effectiveness and the output of the electric resistor are mediocre.

Conventional heating elements moreover do not enable a flushing gas to be injected into the heating zone in order to homogenize the treatment temperature along the bend.

Finally, in cases where steam generator tubes have to be treated over a long period of time, this treatment must be carried out in parallel on what may be a large number of tubes, in order to avoid a total treatment time incompatible with the maintenance program for the nuclear reactor during a stoppage. It is then necessary to have available a large number of heating elements, and if these elements are expensive, the investment required for effecting the stress relieving treatment is considerable.

SUMMARY OF THE INVENTION

The invention therefore seeks to provide a heating apparatus for the heat treatment of a tube of small diameter and of curved shape over at least a part of its length, which apparatus comprises a flexible heating element consisting of an electric resistance wire wound helically to form a winding whose outside diameter is smaller than the inside diameter of the tube, together with an arrangement of means for the guidance, displacement and location of the heating element in the tube, said apparatus being of simple and inexpensive construction and readily adaptable to the shape of the tube to be treated, while permitting the flushing of the heating zone with gas.

To this end, the electric resistance heating wire constitutes the central core of a coaxial cable comprising an outer metal sheath and an insulating material interposed between the central core and the outer sheath, the coaxial cable being wound to form a helical winding.

The invention also relates to the utilization of the apparatus according to the invention for, in particular, effecting the stress relieving heat treatment of the small bends in a bank of tubes in the steam generator of a pressurized water nuclear reactor.

BRIEF DESCRIPTION OF THE DRAWINGS

In order that the invention may be clearly understood, a description will now be given, by way of example, of an embodiment of a heating apparatus according to the invention and of its utilization for relieving the stress of the small bends of a bank of tubes in the steam generator of a pressurized water nuclear reactor.

FIGS. 2*a* and 2*b* are views in longitudinal section of the end portion of a heating element according to the invention, in two different embodiments of the latter.

FIG. 3 is a view in longitudinal section of the rear portion of a heating element.

FIG. 4 is a view in cross-section of a coaxial cable constituting the winding of a heating element according to the invention.

FIG. 5 is a view in section on the line 5—5 in FIG. 3.

FIG. 6 is a section on the line 6—6 in Figure

FIGS. *7a, 7b, 7c* and *7d* are general views of the heating apparatus in the course of four successive phases of an operation enabling a heating element to be used for the heat treatment of a small bend in the bank of tubes of a steam generator.

Figure 8:
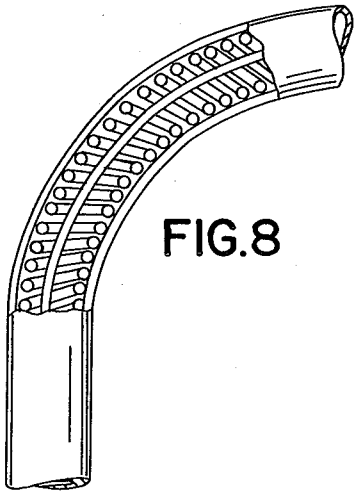

FIG. 8 is a view on a larger scale of a part of FIG. *7d,* showing the heating element in operating position in a small bend.

DESCRIPTION OF PREFERRED EMBODIMENT

Figures 1, 1A:
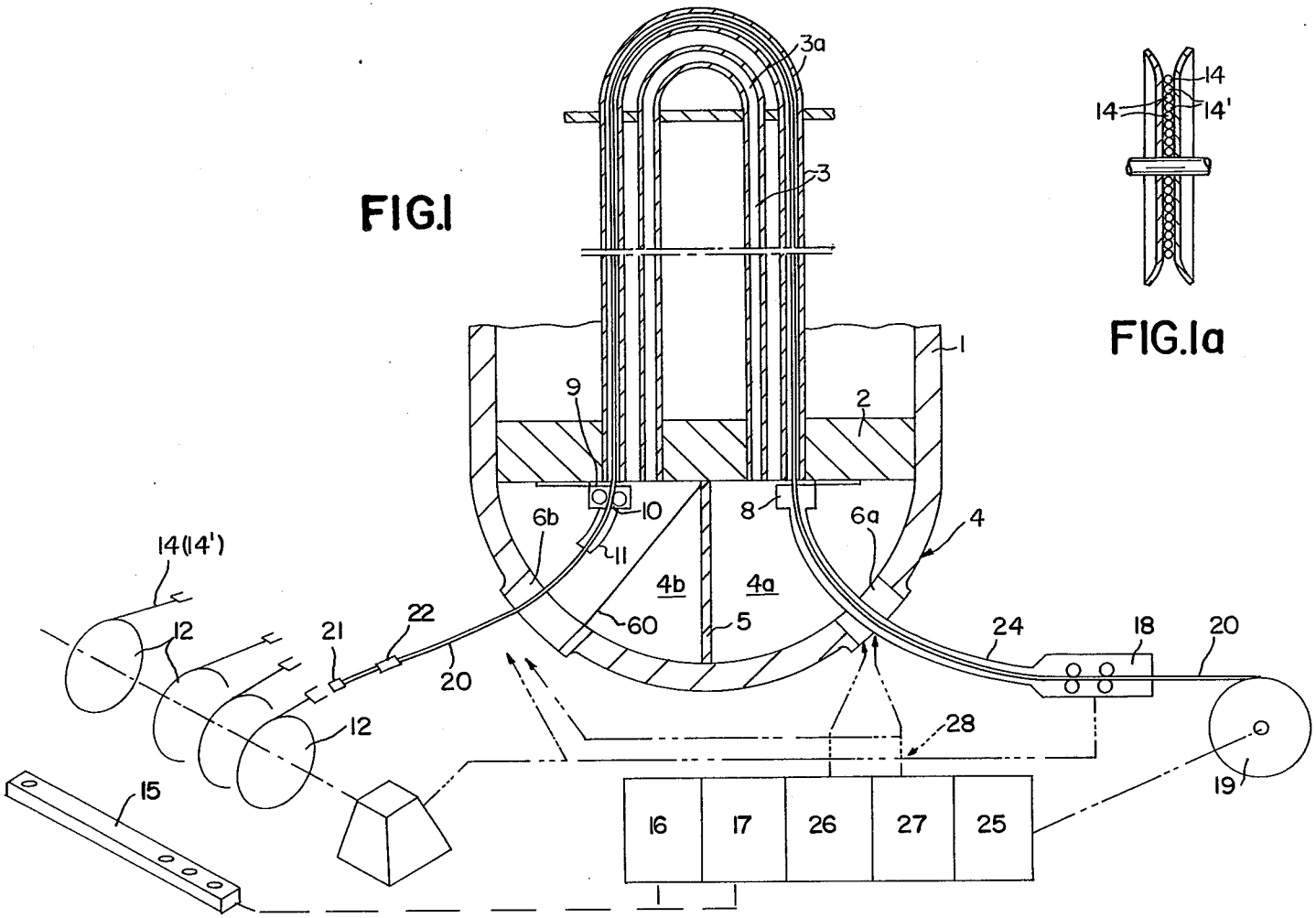
FIG. 1 is a schematic view of the complete heating apparatus used for the heat treatment of the small bends on the steam generator.
FIG. 1*a* is a sectional view of a heating element storage reel.

In FIG. 1 can be seen the bottom part of a steam generator 1 comprising a tube plate 2 which has a considerable thickness and in which the ends of the U-shaped tubes 3 constituting the bank of tubes of the steam generator are fixed. In FIG. 1, the diameter of the tubes 3 has been considerably exaggerated in relation to the dimensions of the tube plate and of the bank of tubes in order to facilitate the representation of the heating apparatus. Two tubes 3 are shown, which are disposed towards the central part of the bank and whose top part 3*a,* curved into semicircular shape, constitutes a small bend of the bank.

The apparatus according to the invention which is shown in FIG. 1 is used for the heat treatment of the parts 3*a* of the tubes 3.

The part of the steam generator situated under the tube plate 2 constitutes a water tank 4 composed of two parts 4*a* and 4*b* separated by a partition 5.

One of the parts of the water tank is connected to piping of the primary reactor circuit which during the operation of the nuclear reactor supplies the pressurized primary water, heated in contact with the core, from the reactor vessel to the steam generator. The other part of the water tank 4 is connected to piping of the primary reactor circuit which, during the operation of the reactor, returns to the vessel the primary water cooled in the steam generator. The primary water circulates inside the tubes 3 between one of their ends, which constitutes an inlet end leading into one of the parts 4*a* or 4*b* of the water tank 4, and their other end, the outlet end, leading into the other part 4*a* or 4*b* of the water tank 4.

The primary pipe systems connected to the steam generator are not shown in FIG. 1.

Each of the parts 4*a,* 4*b* of the water tank has a respective manhole 6*a,* 6*b* which is closed by a leaktight pressure-resistant cover during the normal operation of the nuclear reactor.

The treatment of the steam generator tubes is carried out during a maintenance and repair phase of the nuclear reactor, when the latter has been stopped.

The heating apparatus according to the invention is put into operation inside the steam generator with the aid of the parts 4*a* and 4*b* of the water tank, which serve as compartments giving access to the reactor tubes. The manholes 6*a* and 6*b* are then opened to allow the passage of the equipment necessary for the treatment of the tubes.

For the operation of the heating apparatus according to the invention in a steam generator tube 3, use is made, in each of the parts 4*a* and 4*b* of the water tank, of a conventional handling machine, which is fixed, under the inlet face of the tube plate, in the ends of tubes of the bundle which lead out into said parts 4*a* and 4*b,* and which enables equipment to be placed in position in succession at each of the ends of the tubes which are to be treated, flush with the inlet face of the tube plate. A handling machine of this kind is well known and is commonly used for the testing, closure, mechanical treatment, or repair by sheathing of the tubes of the bank.

All handling operations can be remote controlled from a control station outside the water tank of the steam generator, since a certain degree of radioactivity exists in the tank.

The handling machine makes it possible for a carrier device 8 to be placed in position, in the part 4*a* of the water tank under the inlet face of the tube plate 2, in line with an end of a tube 3 flush with said inlet face. The handling machine also enables a carrier device 9, on which are fixed a puller-pusher 10 and a guide tube 11 of curved shape, to be placed in position in the part 4*b* of the water tank. The tube 11 and the puller-pusher 10 are in line with the end of the tube 3 which is to be treated and which leads out into the part 4*d* of the water tank.

The heating apparatus according to the invention comprises, in addition to support, guide and displacement means 8, 9, 10, 11 situated in the water tank 4, an arrangement of means disposed outside the water tank, in particular a set of reels 12 mounted for rotation on a horizontal shaft on that side of the water tank on which the part 4*b* is situated.

A heating element 14 according to the invention, intended for insertion into the tube 3 in order to subject the latter to heat treatment, is wound onto each of the reels 12. For the purpose of supplying electric heating current to the heating element 14, each of the reels 12 is adapted to be connected to a supply bank 15, which in turn is connected to supply and control cabinets 16 and 17 disposed in a control station from which the operations are controlled.

Each heating element 14 is connected at its front end to an extension 14', which is wound on the reel 12 above the heating element 14.

The heating apparatus also contains a puller-pusher 18 making it possible to move in either direction a traction cable 20 provided at one end with a mechanical connection device 21 and an eddy current position control probe 22. A reel 19 enables the cable 20 to be stored upstream of the puller-pusher 18. A flexible guide tube 24, for example consisting of a stainless steel tube of slight thickness, having a corrugated wall, makes it possible to connect the outlet of the puller-pusher 18 to the carrier 8.

An eddy current position measuring unit 25 and control or operating units 26, 27 for the pullers-pushers 10 and 18 are provided at the control station.

An arrangement of electrical connections 28 makes it possible to connect the pullers-pushers 10 and 18 and position control means to the control units 26 and 27.

Figure 2:
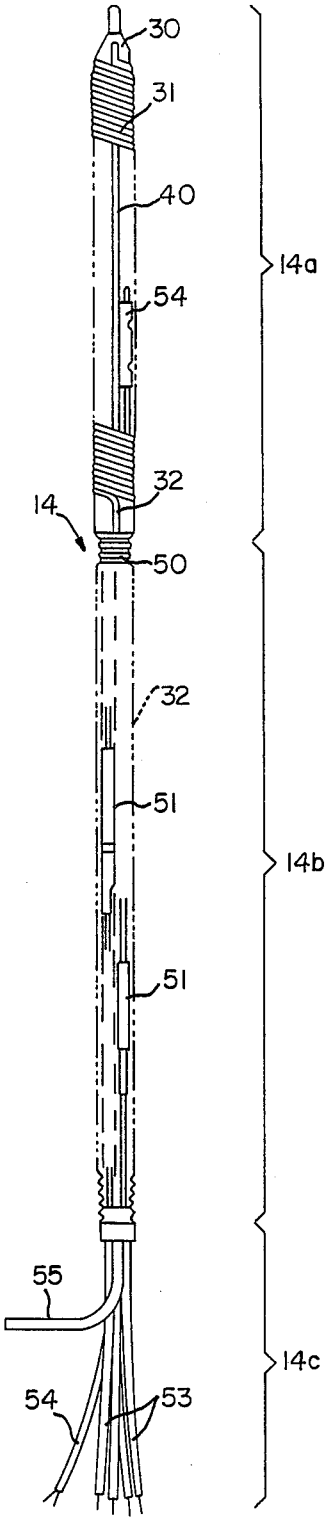
FIG. 2 is a view in elevation and partly in section of a heating element of the apparatus according to the invention.
Figure 7A:
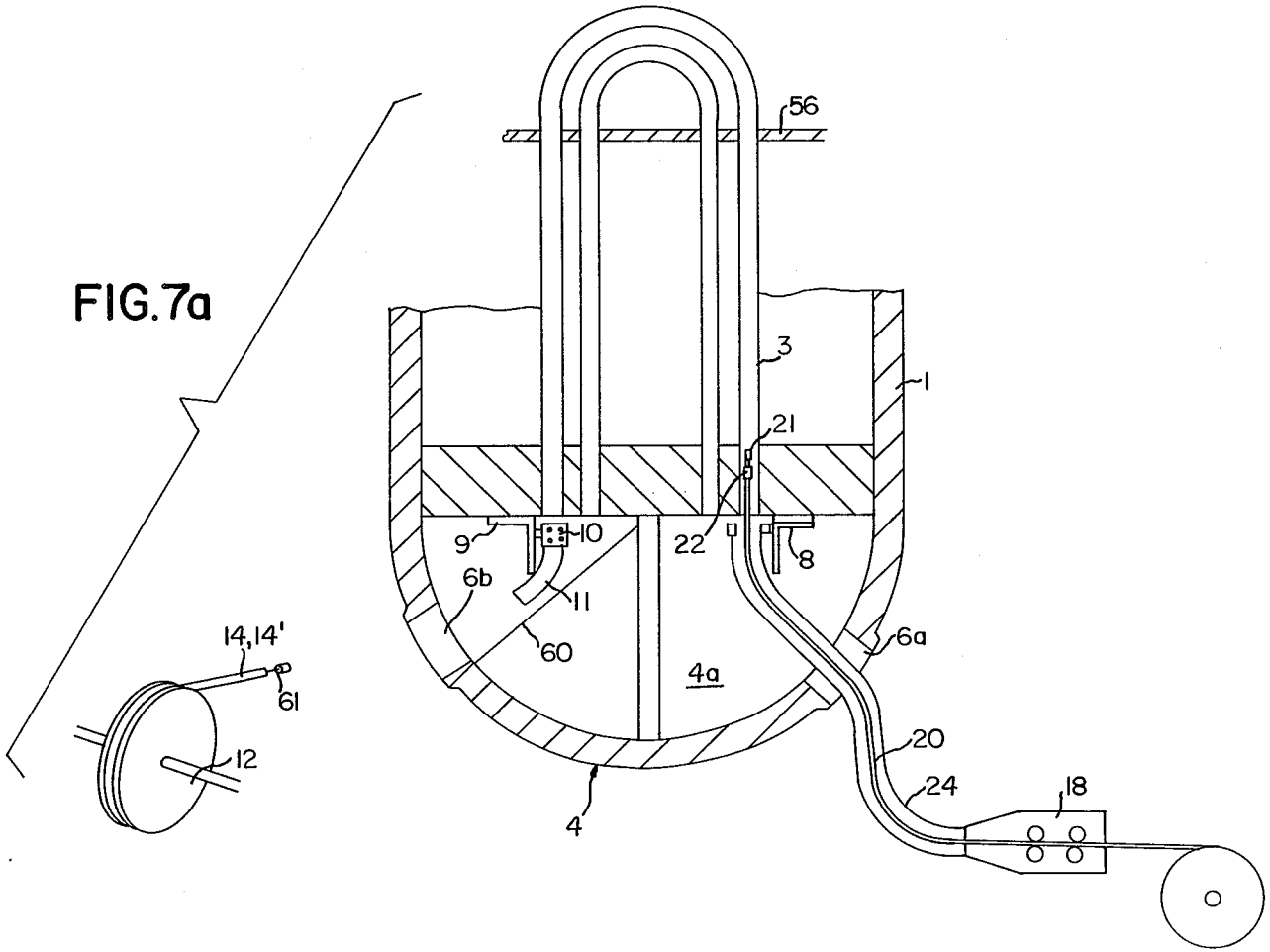
Figure 7B:
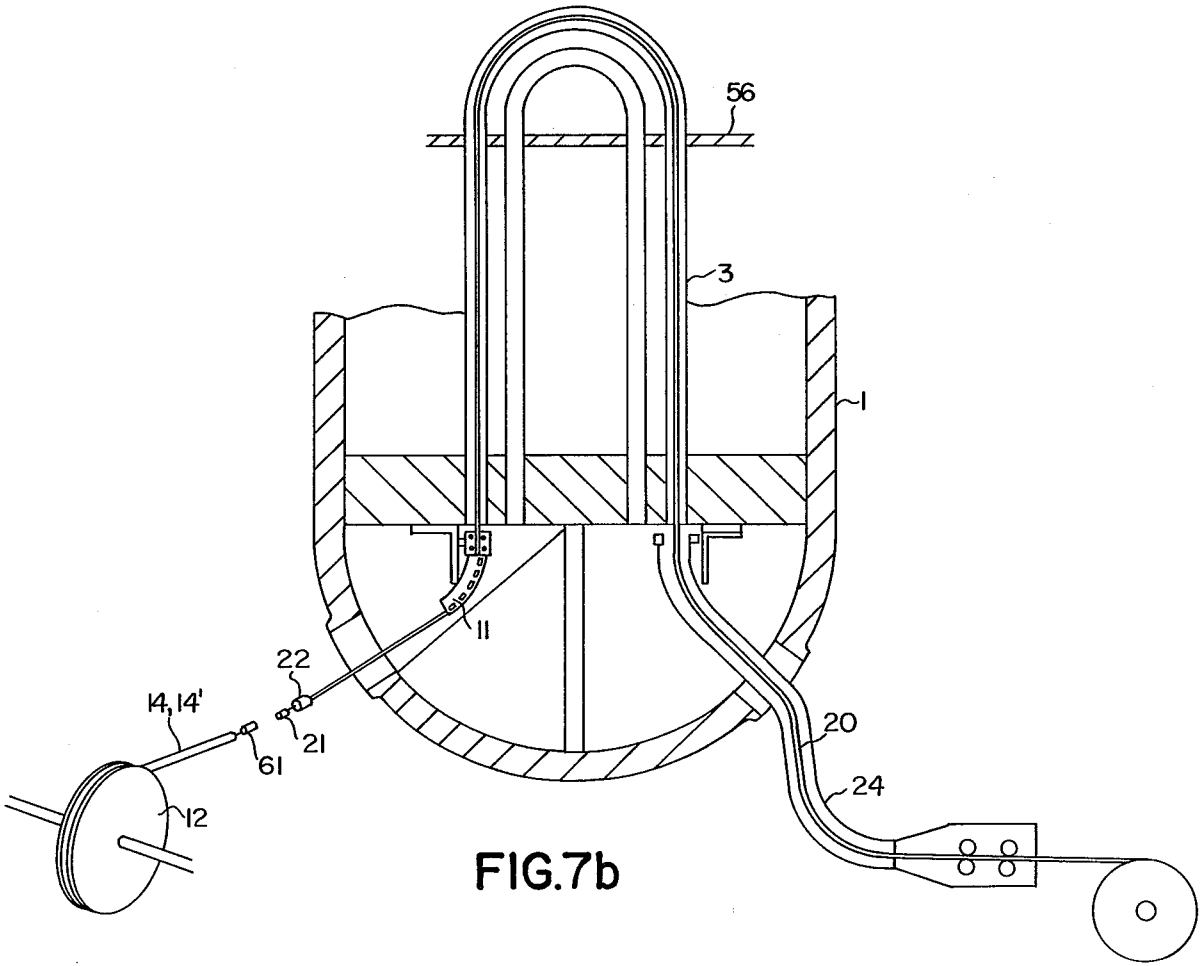
Figure 7C:
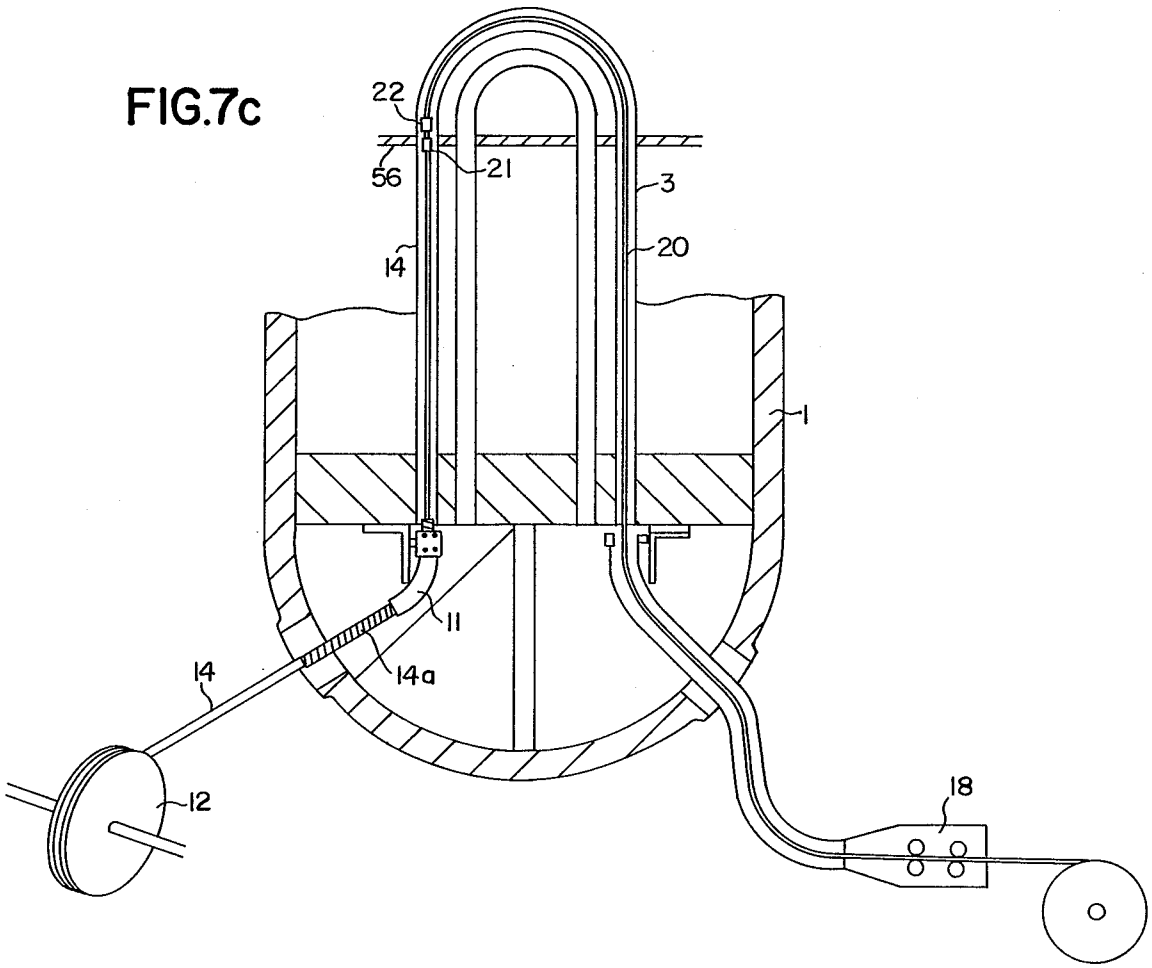
Figure 7D:
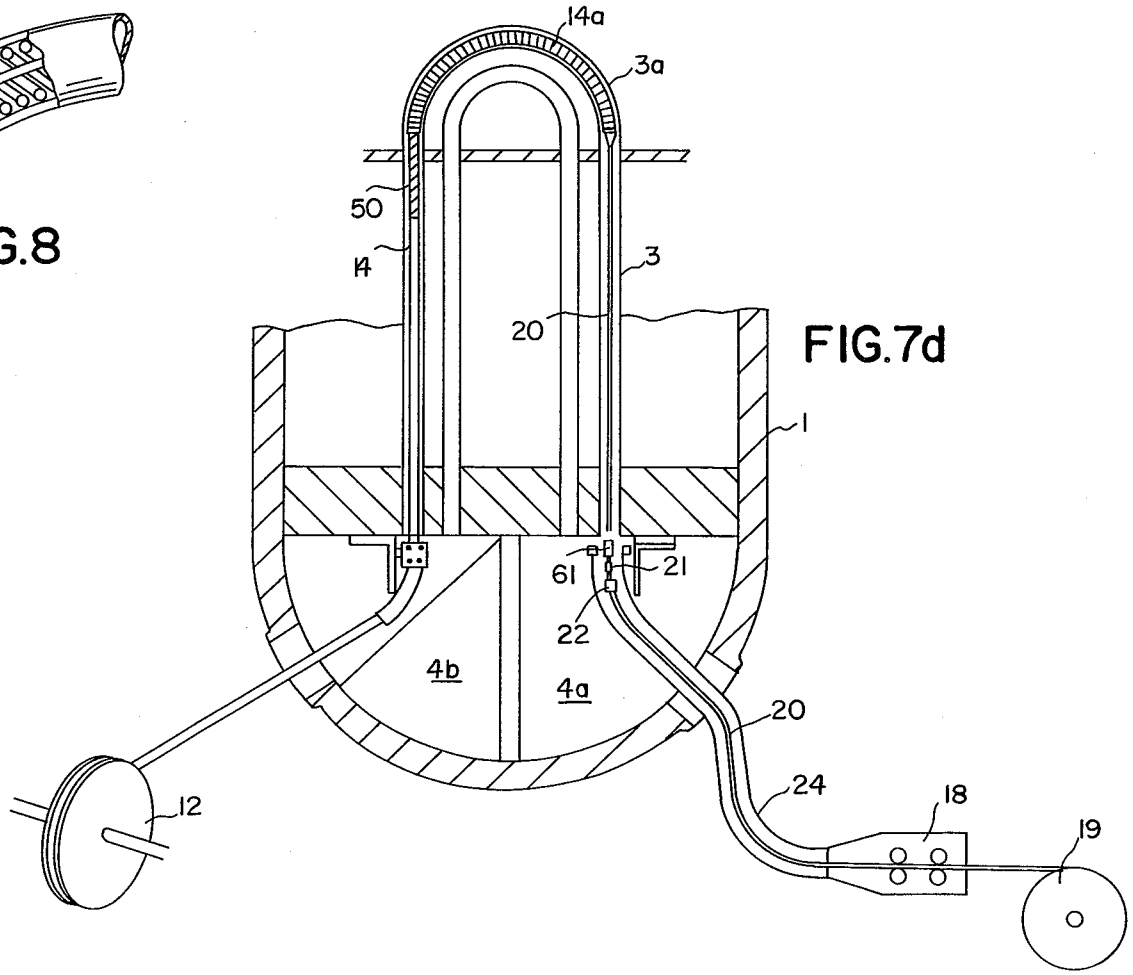

Reference will now be made to FIGS. 2, *2a*, *2b*, 3, 4, 5 and 6 in order to describe the heating element 14 of the apparatus according to the invention.

This element 14 has a front part 14*a*, the end of which consists of an ogival terminal part 30, an intermediate part 14*b* ensuring the passage of the electrical connections and the flushing gas, and a terminal part 14*c* making the connection of the heating element to the electric sources and the source of flushing gas.

The entire heating element is of flexible construction, enabling it to be wound on a reel 12. The diameter of this heating element, at least in its parts 14*a* and 14*b*, is smaller than the inside diameter of a tube 3.

The front part 14*a* constitutes the actual heating element, which is in the form of a helical winding, with contiguous turns, of a coaxial cable 32, the section of which is shown in FIG. 4.

The winding of the coaxial cable 32 is a multiple winding with imbricated turns, the center point of which is disposed at the terminal part 30.

In FIGS. 2, *2b* and 6 the winding shown is a double winding composed of two identical coaxial cables 32 and 32', whose center points are situated at the end part 30. On the other hand, FIG. *2a* relates to a single winding, whose center point is situated in the part 30.

The part 30 has a general ogival shape enabling the heating element to be guided in the tube which is to be treated. This part 30 has at its front end an opening 36 enabling it to be connected to the extension 14'.

Behind the opening 30 the part 30 also has a channel 37 for the passage of the coaxial cable 32, which passes right through the part 30, in a radial direction.

In the case of the embodiment shown in FIG. *2b*, the coaxial cables 32 and 32' are engaged in two channels 37 and 37' extending at right angles to one another and passing through the part 30 in longitudinally offset positions.

The channels 37 and 37' enable the center points to be formed on the windings consisting of imbricated turns of the coaxial cables 32 and 32'. The cable 32 or the cables 32 and 32' are wound in contiguous or practically contiguous turns, as can be seen in FIGS. *2a*, *2b* and 3.

As FIG. 4 shows, the coaxial cable 32 comprises a central conductor 33 consisting of an electric resistance heating wire, for example of nickel-chrome alloy. The coaxial cable also has a metallic outer sheath 34, for example of nickel alloy stainless steel or other metallic material, coaxial to the resistance wire 33. Between the wire 33 and the sheath 34 electric insulating material 35 is inserted.

It is quite obvious that a coaxial cable such as the cable 32 has a certain rigidity due to the presence of the tubular outer sheath 34. When this coaxial cable is shaped to form a winding 31, the latter has properties fairly similar to those of a coil spring. This winding constitutes in particular a structure which is stable but subject to elastic deformation, particularly in flexion.

In contrast to conventional heating elements which consist of a winding composed of a simple electric resistance wire on a flexible mandrel, the heating element according to the invention has a definite shape and sufficient cohesion without it being necessary to wind its turns in contact with an internal mandrel.

As can be seen in FIGS. *2a*, *2b* and 3, the heating element nevertheless has in its part 14a a central portion consisting of a tie 40 of small diameter and of a winding 41 made from a flat metal tape.

The tie 40 may advantageously consist of a rod or tube which is flexible but has good rigidity in traction, and which is able to withstand the temperature prevailing inside the heating element 14. The tie 40 is fastened at one end to the terminal member 30 and extends axially inside the heating element 14 over the entire part 14*a* of the latter, before passing through an axial bore in an end member or core 43 constituting the junction member between the parts 14*a* and 14*b* of the heating element 14. The end of the tie 40 opposite to the terminal member 30 is fastened to an annular member 44 adapted to bear against an annular member 45 fixed in the end portion of the part 14*b* of the heating element. The end of the member 45 is separate from the corresponding end of the member 43 in order to allow a certain adjustment.

The part 14*a* of the heating member can thus be deformed in flexion and optionally in compression if the turns are not perfectly contiguous, but is not subject to elongation through traction, because of the presence of the tie 40 connecting together in respect of traction the terminal member 30 and the part 14*b* of the heating element.

The winding 41 consisting of a flat metal tape forms turns inclined in the direction opposite to that of the turns of the winding 31. This perfectly flexible winding 41 thus makes it possible to prevent excessive deformation of the winding 31 through displacement of its turns in radial directions.

It should be noted that a radial space is provided between the inner surface of the winding 31 and the outer surface of the winding 41 which, together with the tie 40, constitutes the central part of the heating element 14. This central part does not under any circumstances constitute a mandrel on which the coaxial cable 32 is wound, since a radial space is always left between the winding 31 and the central part.

The winding 31 thus constitutes a self-supporting tubular member having the properties of a spring comprising contiguous turns.

In most cases, it will not even be necessary to provide a central support member such as the winding 41. However, when the heating element is made in the form of a multi-turn winding, a member of this kind may be required.

FIGS. 2 and 3 show that the intermediate part 14*b* of the heating element 14 is composed of a stainless steel tube 50 having successive corrugations giving it good flexibility. The coaxial cables 32 and 32', in the case of a double two-conductor winding, are disposed in the axial direction inside the tubular sheath 50, and connectors 51 enable these cables 32 and 32' to be connected to flexible electricity supply cables.

It should be observed that, when use is made of two coaxial cables 32 and 32' constituting a double heating winding, these coaxial cables are connected in parallel to the supply, thus making it possible to use a heating voltage reduced by half for the same heating power.

In general, the connection will be made by flexible cables of conventional type, which are connected to the coaxial cables 32 and 32' by the connectors 51 spaced apart inside the intermediate part 14*b* of the heating element.

At least one thermocouple 54 is disposed in the part 14*a* of the heating element and makes it possible to measure the temperature during the heating; this thermocouple comprises a measuring cable 53 which also extends in the axial direction inside the tubular sheath 50. The ends of the flexible cables connected to the coaxial cables 32 and 32' and the end of the measuring cable 53 of the thermocouple constitute the terminal part 14*c* connecting the heating element to the fixed installations situated outside the steam generator.

The tubular sheath 50 is fed with a flushing gas, which may for example be an inert gas, such as argon or helium, by way of a pipe 55 connected to an inert gas tank outside the steam generator. The flushing gas can circulate inside the sheath 50 as far as that part of the the sheath which is close to the member 43, where the sheath has small openings 50' through which the flushing gas can pass in order then to circulate inside the tube 3 into which the heating element 14 has been inserted. A part of the gas can also pass through the member 43 in the clearance allowed around the conductors 32 and the tie 40. This gas then flows inside the winding 31 constituting the operative front part 14*a* of the heating element 14. This winding 31 constitutes a tubular passage which is not gas-tight, since the turns are not perfectly contiguous. The gas therefore finally flows into the tube 3, and it is thus possible to achieve effective flushing of the heating zone of the tube.

FIG. 5 shows the arrangement of the coaxial cables 32 and the tie 40 inside the corrugated tubular sheath 50. The position of the coaxial cables 32' has also been shown for cases in which a double winding is used, as illustrated in FIGS. 2 and 2*b*.

Reference will now be made to FIGS. *7a*, *7b*, *7c* and *7d* in order to describe an operation for placing in position and utilizing the heating element for the heat treatment of the bend of a tube 3 disposed in the central part of the steam generator.

A set of heating elements 14, each wound on a reel 12 and connected to an extension 14', as shown in FIG. 1*a*, is disposed outside the steam generator, close to the manhole 6*b*. In FIGS. *7a* to *7d* a single reel 12 and a single heating element, which will be used for the heat treatment of the bend of the tube 3, are shown.

The carriers 8 and 9 have been placed at the ends of the tube 3, thus achieving the placement in position of the tube 24, the puller-pusher 10 and its guide tube 11.

The traction cable 20, provided at its end with a coupling device 21, is passed into the tube 24 with the aid of the puller-pusher 18, thus enabling it to be inserted into one end of the tube 3 (FIG. *7a*).

The action of the puller-pusher 18 then enables the traction cable 20 to be moved inside the tube 3, since this cable has sufficient rigidity to be moved by pushing.

The end of the cable 20 thus reaches the outlet of the tube 3 and then that of the guide tube 11. A guide 60 then enables it to be extracted through the manhole 6*b*.

As can be seen in FIG. *7b*, the coupling device 21 is brought close to the terminal member 61 of the extension 14' wound on the reel 12. The extension 14' is then coupled manually or automatically to the cable 20 by engaging the device 21 in an opening in the member 61.

The puller-pusher 18 is then operated to apply traction to the cable 20, to the extension 14' and to the heating element 14. The puller-pusher 10 may optionally be operated with a pushing action in order to facilitate the introduction of the heating element 14 into the tube 3. As shown in FIG. *7c*, the eddy current coil 22 of the traction cable 20 arrives at the top spacer 56 of the bundle of tubes, and this position is detected with the aid of the eddy current measuring device 25 provided in the control station. The position of the puller-pusher 18 is noted, and the movement of the extension 14' and of the heating element 14 continues until the eddy current coil 22 of the cable 20 arrives at the top spacer plate 56 in its downward movement in the tube 3, at the outlet of the small bend 3*a*. The position of the puller-pusher 18 is then noted.

The two measurements of position on the puller-pusher 18 make it possible to determine the length of flexible cable 20 introduced into the tube when the end of the cable is in two symmetrical positions on each side of the small bend 3*a*. The mean of these two lengths then makes it possible to determine accurately the position of the center point of the bend, which is also its highest point.

When the position of the flexible cable shown in FIG. *7d* has been detected with the aid of the eddy current coil 22, the heating element 14 has then been brought into its operative position inside the bend, as shown in FIGS. *7d* and 8. The operative part 14*a* of the heating element, i.e., the helical winding 31, has a length at least equal to the length of the largest bends to be treated, so that the whole of the bend 3*a* is occupied by the heating winding 31.

FIG. 8 shows that the heating element 14 is able to adapt itself perfectly to the shape of a small bend, with the walls of which it comes into contact in order to ensure good transmission of heat.

During the movements of the heating element inside the tube 3, the presence of the tie 40 inside the heating element 14 makes it possible to avoid any abnormal elongation of the winding 31 through extension caused by traction. The traction applied by the cable 20 is in fact transmitted from the terminal member 30 to the tubular sheath 50 of the intermediate part 14*b* of the heating element by way of the tie 40.

If the tube 3 is slightly ovalized in a part of the bend, the turns of the winding 31, which are not rigidly supported by a central mandrel, can be slightly displaced or deformed in order to facilitate the passage of the heating element in the bend. The displacement or deformation of the turns of the winding 31 is limited to a low level, which is however sufficient to allow the heating element to pass through the bend, by the inner winding 41 of the heating element.

The heat treatment of the bent portion of the tube 3 is carried out by switching on the electricity supply of the reel 12, to which the ends of the supply cables constituting the terminal part 14*c* of the heating element are connected. The heating current is controlled and monitored by the devices 16 and 17 situated in the control station of the installation.

The treatment can be carried out simultaneously on a very large number of tubes, so that the operation of placing a heating element in position, as described above, is effected successively for all the tubes which are to be treated. The supply of current to the heating elements and the monitoring of the heating current take place simultaneously and in parallel for all the tubes which are to be treated.

After each operation of placing the heating elements in position, the coupling device 21 of the cable 20 is disconnected from the member 61 of the extension 14' of the heating element 14 which has just been placed in position, by means of remote control at the carrier 8. The traction cable 20 is then withdrawn, while the element 14 and the extension 14' remain in position in the tube 3.

During the heat treatment, flushing gas is supplied to the heating zone, inside the tube 3, by way of the tube 50.

The temperature is permanently monitored by the thermocouple 54, the measurements made by which are transmitted to the control station.

The apparatus according to the invention therefore has the advantage of simple construction, moderate cost, and of being able to be easily placed in position inside the small bends of the bank of tubes.

The apparatus according to the invention also makes it possible to monitor perfectly the heat treatment operation and the position of the heating elements in the bends before they are put into operation. The heating windings may be composed of any number of coaxial cables whose turns are imbricated.

The central part of the heating element may be constructed in a form different from that described above.

It is possible to conceive the utilization of windings whose heating power is greater at the ends intended to coincide with those parts of the tube which pass through the top spacer than in the central part. A variation of the heating power of this kind can be obtained either by using for the construction of the winding a coaxial cable whose central core consists of successive portions whose resistivity is variable, or by constructing the winding with a diameter of the turns which varies along its length.

The various successive portions of the cable core possessing variable resistivity may be composed of lengths of different resistance wires butt welding together.

The coaxial cable may comprise portions of low electrical resistance, for example of copper, which are intended for joining portions of high electrical resistance and which constitute non-heating conductive zones of the heating element.

The means for the movement, the positioning and the monitoring the heating element may also have a different form from that described above.

Finally, the apparatus according to the invention can be used for the heat treatment of any tube of small diameter which has a curved shape over a part of its length, or obviously for the treatment of straight tubes.

I claim:

1. Heating apparatus for the heat treatment of a tube (3) of small diameter and of curved shape over at least part of its length, which apparatus comprises a flexible heating element (14) consisting of an electric resistance wire (33) wound helically to form a winding whose outside diameter is smaller than the inside diameter of the tube (3), together with an arrangement of means (8, 9, 10, 11, 12, 18, 25, 26, 27) for guidance, displacement and location of the heating element (14) in the tube (3), wherein the electric resistance heating wire (33) constitutes the central core of a coaxial cable (32) comprising an outer tubular metal sheath (34) and an insulating material (35) interposed between the central core (33) and the outer sheath (34), the coaxial cable (32) being wound to form a helical winding (31).

2. Heating apparatus according to claim 1, wherein the heating element (14) contains in its central part, along the axis of the winding (31), a tie (40) which is deformable in flexion but rigid in traction and which is fixed at its ends to two parts (30, 43) of the heating element (14) which are situated one on each side of the winding (31) in the axial direction of said winding.

3. Heating apparatus according to claim 1 or 2 wherein the heating element (14) has an end member (30) of profiled shape enabling the heating element (14) to be guided in the tube and provided with coupling means (36) for its connection to a member (14') by means of which traction is applied to the element (14) for the purpose of moving it in the tube (3).

4. Heating apparatus according to claim 2, wherein the tie (40) is fixed at one end to the terminal member (30.

5. Heating apparatus according to claim 4, wherein the end member (30) has at least one channel (37) for the passage of the coaxial cable (32) constituting the winding (31) of the heating element (14), that portion of the coaxial cable (32) which is received in the channel (37) constituting the center point of the winding (31).

6. Heating apparatus according to claim 1, wherein the winding (31) is a multiple winding having imbricated turns.

7. Heating apparatus according to claim 1, wherein the central core (33) of the coaxial cable (32) comprises successive portions having different resistivities.

8. Heating apparatus according to claim 1, wherein the helical winding (31) of the coaxial cable (32) has a variable turn diameter depending on the position of the turn in the axial direction of the winding.

9. Heating apparatus according to claim 1, wherein the heating element (14) contains, in its central part inside the winding (31), a winding (41) consisting of a flat metallic tape and having a pitch directed oppositely that of the winding (31), while its diameter is smaller than the inside diameter of the winding (31).

10. Heating apparatus according to claim 1, containing, as an axial extension of an operative zone **(14*a*) consisting of the winding (31), a part (14*b*) composed of a flexible metallic tube (50) provided with openings (50') in its wall near its end connected to the operative zone (14*a*) and communicating at its other end with a flushing gas supply pipe (55)**.

11. Heating device according to claim 10, wherein, extensions of the coaxial cable constituting the winding (31) are disposed axially in the metallic tube (50) and pass out of said tube by its end opposite to the winding (31) for connection to electricity supply means.

12. Heating apparatus according to claim 1, wherein the means for the movement of the heating element (14) in the tube (3) comprise an extension (14') connected to the heating element (14) and a traction cable (20) having an end member (21) for coupling to the end of the extension (14') opposite to the end connected to the heating element (14).

13. Heating apparatus according to claim 12, wherein the cable (20) carries near the coupling member (21) an eddy current coil (22) for detecting the position of the cable (20) and of the heating element (14) in the tube (3).

14. Heating apparatus according to claim 1, wherein the means for guiding and moving the heating element (14) comprise guide tubes (11, 24) situated in line with the ends of the tube (3), together with pullers-pushers (10, 18) equipped with rotating rollers.

* * * * *